US008640826B1

(12) United States Patent
Beilstein

(10) Patent No.: US 8,640,826 B1
(45) Date of Patent: Feb. 4, 2014

(54) TRAILER RUB RAIL PORTABLE LADDER

(76) Inventor: Richard R. Beilstein, Cedarburg, WI (US)

( * ) Notice: Subject to any disclaimer, the term of this patent is extended or adjusted under 35 U.S.C. 154(b) by 84 days.

(21) Appl. No.: 13/328,077

(22) Filed: Dec. 16, 2011

(51) Int. Cl.
*E06C 1/00* (2006.01)

(52) U.S. Cl.
USPC ..... 182/127; 182/106; 182/206; 114/362

(58) Field of Classification Search
USPC ..... 182/97, 106, 127, 206, 64.1, 68.1; 280/163; 114/362
See application file for complete search history.

(56) References Cited

U.S. PATENT DOCUMENTS

| | | | | | |
|---|---|---|---|---|---|
| 3,973,646 | A * | 8/1976 | Martinez | 182/97 |
| 4,017,093 | A * | 4/1977 | Stecker, Sr. | 280/163 |
| 4,153,137 | A * | 5/1979 | Johnson | 182/97 |
| 4,199,041 | A * | 4/1980 | Gutner | 182/206 |
| 4,798,262 | A * | 1/1989 | Margolies | 182/106 |
| 4,819,296 | A * | 4/1989 | Wilkins | 16/82 |
| 4,823,910 | A * | 4/1989 | Day | 182/84 |
| 5,024,292 | A | 6/1991 | Gilbreath et al. | |
| 5,213,367 | A * | 5/1993 | Norman et al. | 280/837 |
| 5,687,813 | A | 11/1997 | Bensch | |
| 5,887,540 | A * | 3/1999 | Krish, Jr. | 114/362 |
| 5,941,342 | A * | 8/1999 | Lee | 182/95 |
| 5,964,317 | A * | 10/1999 | Lattavo | 182/127 |
| 6,003,633 | A * | 12/1999 | Rolson | 182/127 |
| 6,290,113 | B1 * | 9/2001 | Plyler | 224/315 |
| 6,505,708 | B2 * | 1/2003 | LaBrash | 182/127 |
| 6,578,666 | B1 | 6/2003 | Miller | |
| 6,866,117 | B2 * | 3/2005 | Moss | 182/23 |
| 6,905,153 | B2 * | 6/2005 | Murray et al. | 293/115 |
| 7,516,997 | B2 * | 4/2009 | Kuznarik et al. | 296/62 |
| 8,104,577 | B1 * | 1/2012 | Reed | 182/127 |
| 8,474,576 | B2 * | 7/2013 | Renish | 182/129 |
| 2003/0188923 | A1 * | 10/2003 | Moss | 182/23 |
| 2004/0129497 | A1 * | 7/2004 | Weiss | 182/163 |
| 2005/0092800 | A1 * | 5/2005 | Wilson | 224/513 |
| 2005/0121260 | A1 * | 6/2005 | Leng | 182/156 |
| 2005/0173191 | A1 * | 8/2005 | Linzmayer | 182/127 |
| 2005/0211502 | A1 * | 9/2005 | LaBrash | 182/127 |
| 2010/0089698 | A1 * | 4/2010 | Brodsack | 182/127 |
| 2010/0096215 | A1 * | 4/2010 | McFarlane | 182/106 |

* cited by examiner

*Primary Examiner* — Katherine Mitchell
*Assistant Examiner* — Daniel Cahn
(74) *Attorney, Agent, or Firm* — Donald J. Ersler

(57) ABSTRACT

A trailer rub rail portable ladder includes a ladder portion and two rub rail mounting members. One end of a hand rail may be attached to each rub rail mounting member. The ladder portion preferably includes two ladder side rails, a plurality of step members and two ladder hinge members. The plurality of step members are retained between the two ladder side rails. The ladder hinge member is attached to one end of the ladder side rail. Each rub rail mounting member includes a rail slot and a pivot hole. A pivot pin is inserted through each ladder hinge member and each rub rail mounting member to pivotally retain thereof relative to each other. The rub rail slots of the two rub rail mounting members are engaged with a rub rail of a truck trailer.

13 Claims, 7 Drawing Sheets

FIG. 5
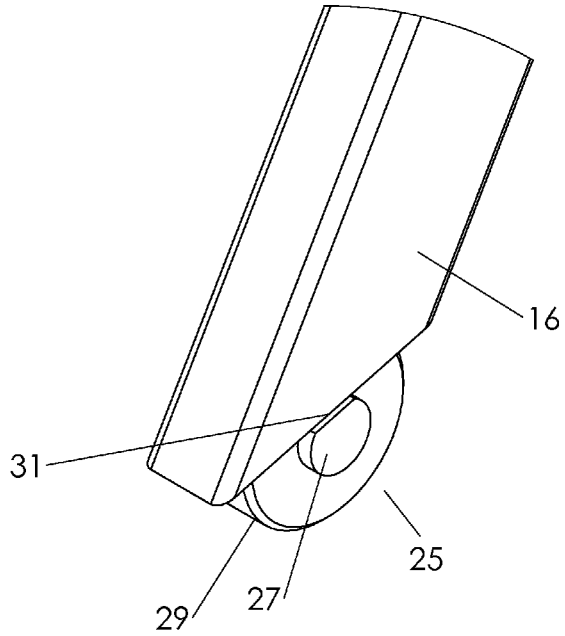
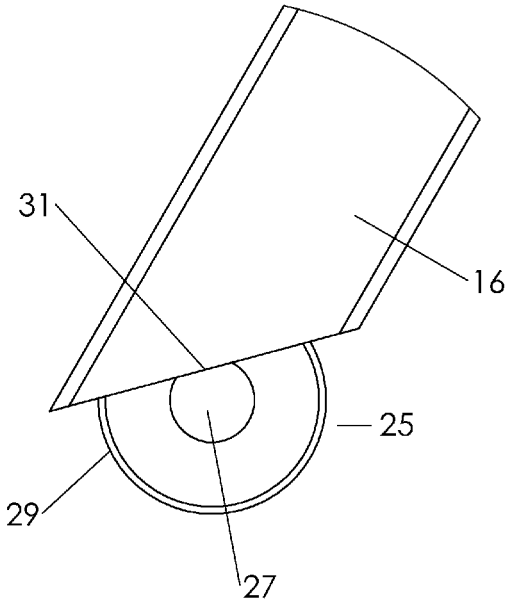
FIG. 6

TRAILER RUB RAIL PORTABLE LADDER

BACKGROUND OF THE INVENTION

1. Field of the Invention

The present invention relates generally to truck trailers and more specifically to a trailer rub rail portable ladder, which may be removably secured to the rub rail of a truck trailer.

2. Discussion of the Prior Art

U.S. Pat. No. 4,199,041 to Gunter discloses a bunk bed-ladder arrangement. U.S. Pat. No. 5,024,292 to Gilbreath et al. discloses a portable ladder assembly for truck trailers. U.S. Pat. No. 5,687,813 to Bensch discloses a vehicle boarding device. U.S. Pat. No. 6,578,666 to Miller discloses a portable safety ladder assembly for a truck trailer.

Accordingly, there is a clearly felt need in the art for a trailer rub rail portable ladder, which may be removably secured to the rub rail of a truck trailer with a locking device or the like.

SUMMARY OF THE INVENTION

The present invention provides a trailer rub rail portable ladder, which may be removably secured to the rub rail of a truck trailer. The trailer rub rail portable ladder (rub rail ladder) includes a ladder portion and two rub rail mounting members. One end of a hand rail may be attached to each rub rail mounting member. The ladder portion preferably includes two ladder side rails, a plurality of step members and two ladder hinge members. One end of each step member is attached to one of the two ladder side rails and the other end of each step member is attached to the other one of the two ladder side rails. The ladder hinge member is attached to one end of the ladder side rail. The ladder hinge member includes a through opening. A fastener is retained in the through opening and preferably extends from the ladder hinge member.

Each rub rail mounting member preferably includes a rail slot, a pivot hole and a lock through opening. The rail slot is formed in one end of the rub rail mounting member and a hand rail slot may be formed in an opposing end of the rub mail mounting member. The hand rail slot preferably has a substantial V-shape. The fastener retained in each ladder hinge member is inserted through the pivot hole of the rub rail mounting member. The rub rail mounting member is preferably pivotally retained on the ladder side rail with a nut. One end of the hand rail is shaped to be received by the hand rail slot. The hand rail is preferably attached to the rub rail mounting member with welding.

In use, the rail slots of the two rub rail mounting members are engaged with a rub rail of a truck trailer. It is preferable to insert a fastener or a bolt of a lock through the lock through opening of at least one of the rub rail mounting members to secure the rub rail ladder to the truck trailer.

Accordingly, it is an object of the present invention to provide a rub rail ladder, which may be removably secured to the rub rail of a truck trailer with a locking device or the like.

These and additional objects, advantages, features and benefits of the present invention will become apparent from the following specification.

BRIEF DESCRIPTION OF THE DRAWINGS

FIG. 5 is an enlarged perspective view of a bottom end of a ladder side rail of a ladder portion with a wheel pivotally retained therein of a rub rail ladder in accordance with the present invention.

FIG. 6 is an enlarged side view of a bottom end of a ladder side rail of a ladder portion with a wheel pivotally retained therein of a rub rail ladder in accordance with the present invention.

DETAILED DESCRIPTION OF THE PREFERRED EMBODIMENTS

Figure 1:
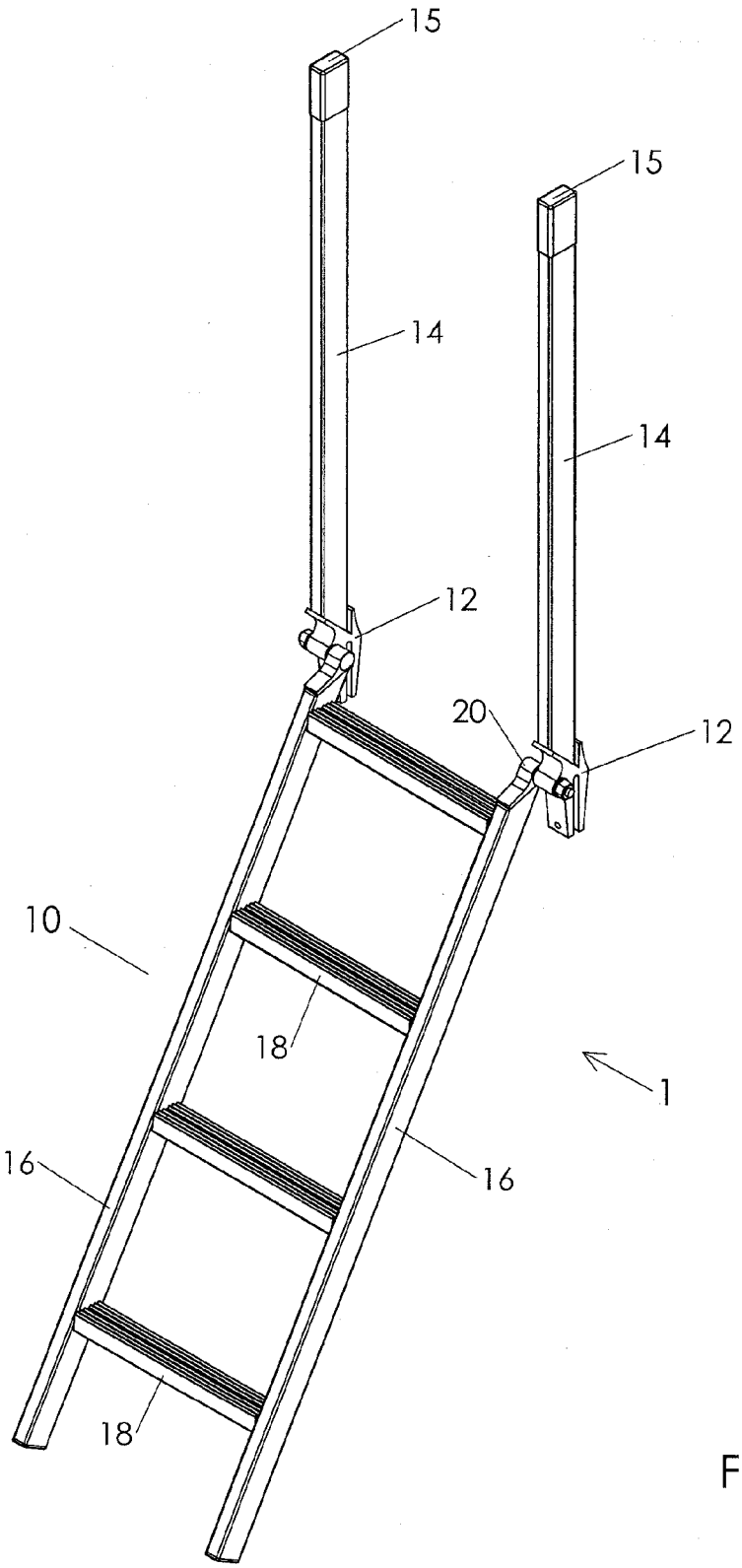
FIG. 1 is a perspective view of a rub rail ladder in accordance with the present invention.
Figure 1A:
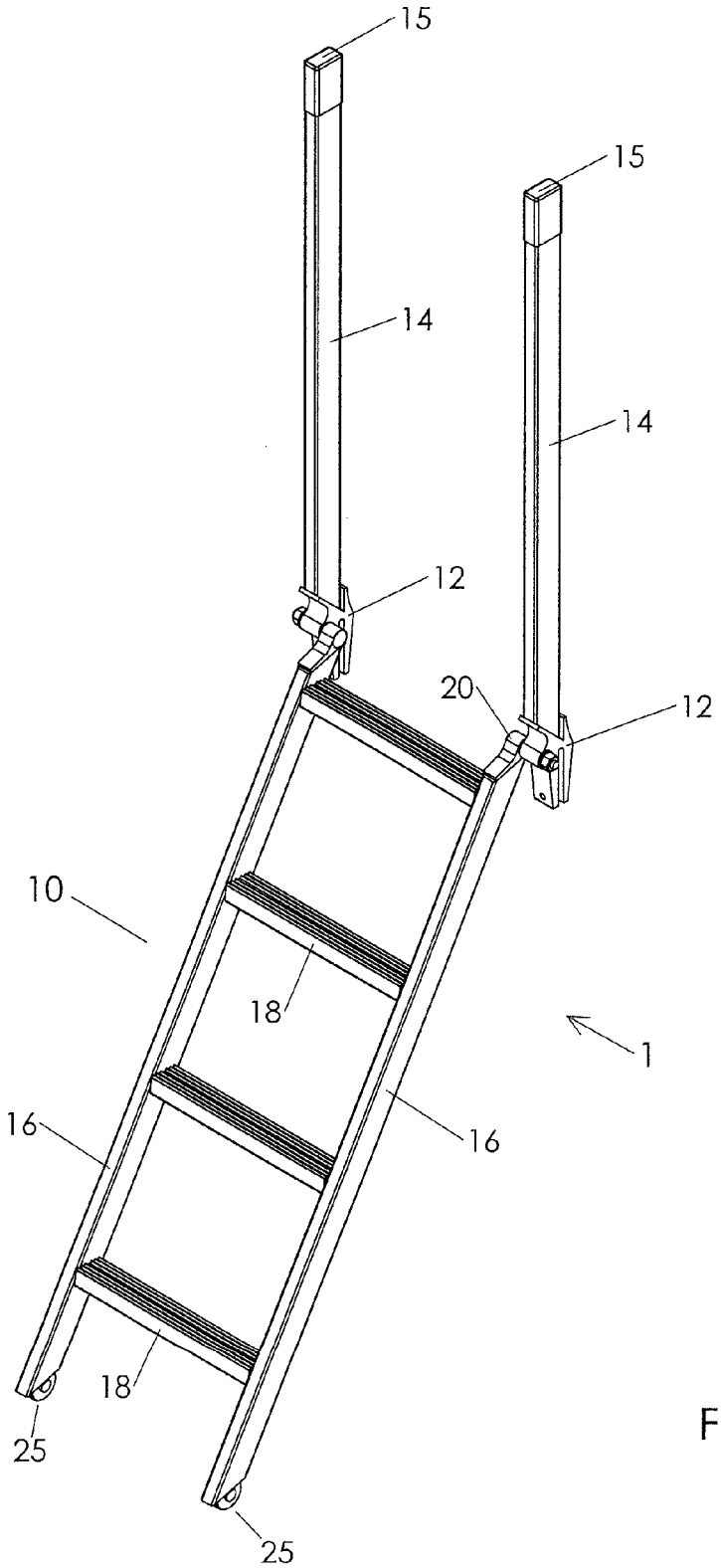
FIG. 1*a* is a perspective view of a rub rail ladder with wheels retained on a bottom of a ladder portion in accordance with the present invention.
Figure 2:
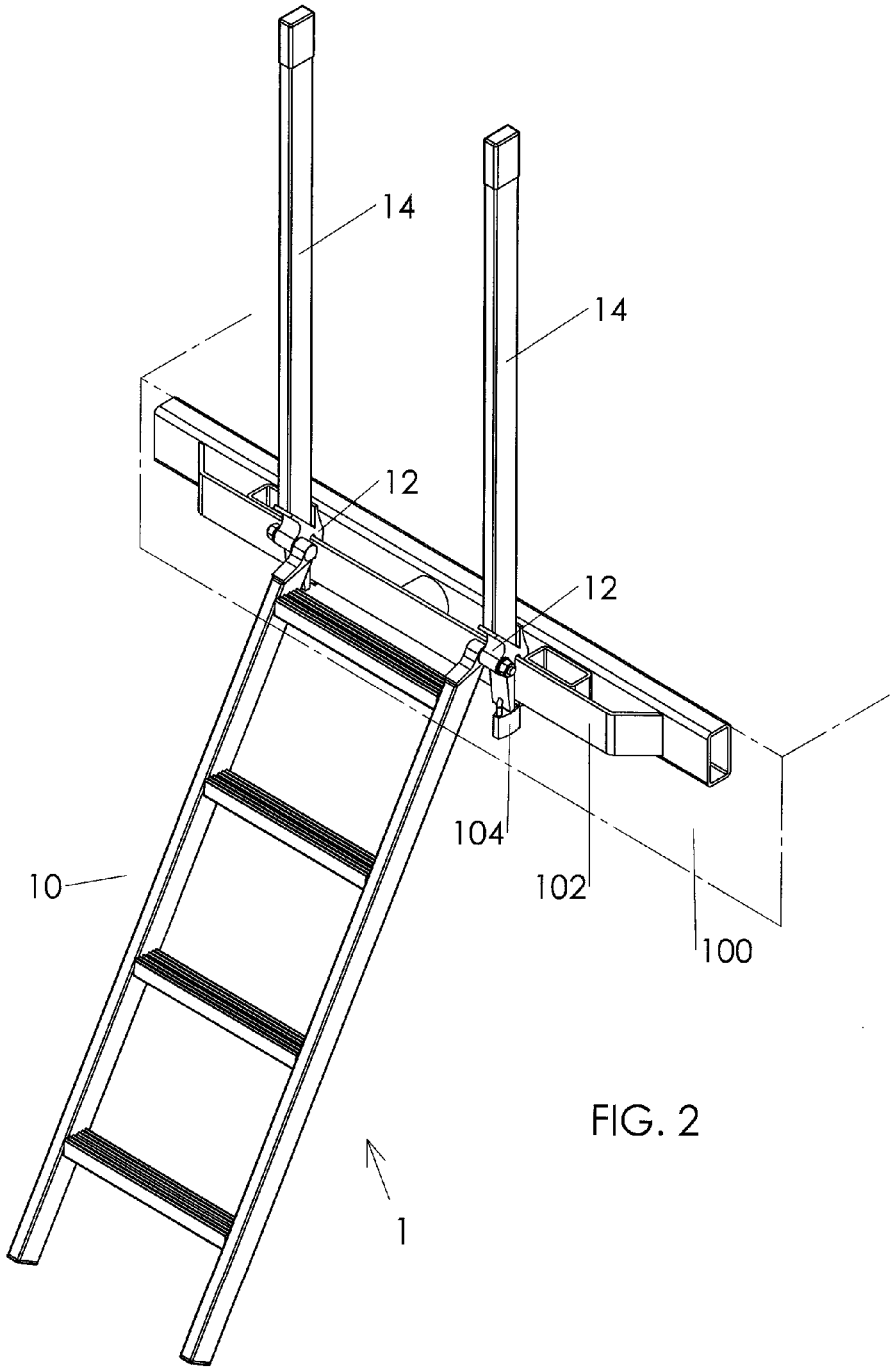
FIG. 2 is a perspective view of a rub rail ladder attached to a rub rail of a truck trailer in accordance with the present invention.
Figure 2A:
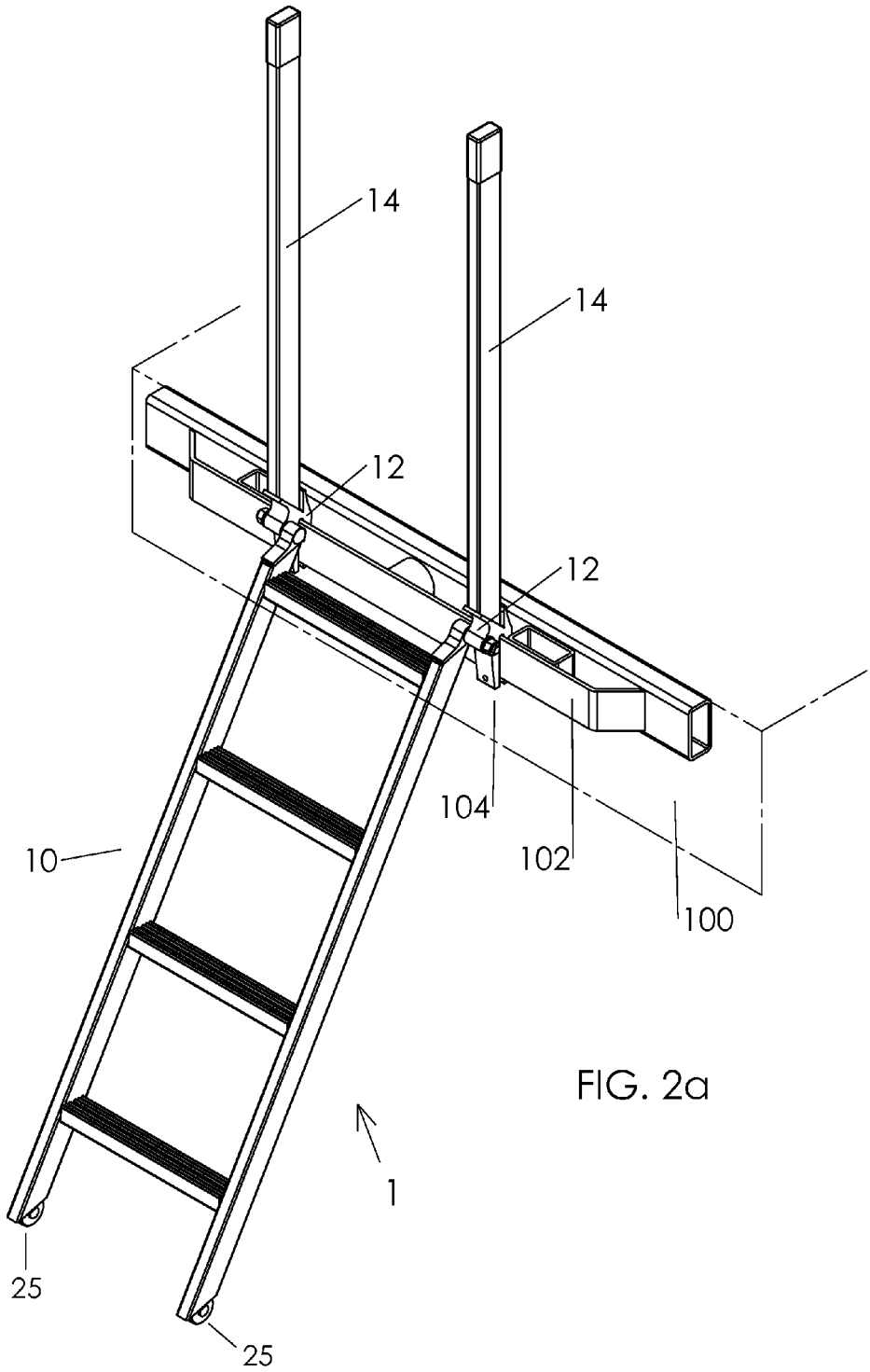
FIG. 2*a* is a perspective view of a rub rail ladder with wheels retained on a bottom of a ladder portion and the rub rail ladder attached to a rub rail of a truck trailer in accordance with the present invention.

With reference now to the drawings, and particularly to FIG. 1, there is shown a perspective view of a rub rail ladder 1. The rub rail ladder 1 includes a ladder portion 10 and two rub rail mounting members 12. One end of a hand rail 14 may be attached to each rub rail mounting member 12. The hand rail 14 is preferably fabricated from a rectangular tube and an opening end terminated with an end cap 15. The ladder portion 10 preferably includes two ladder side rails 16, a plurality of step members 18 and two ladder hinge members 20. The ladder side rails 16 are preferably fabricated from a rectangular tube. One end of each step member 18 is attached to one of the two ladder side rails 16 with welding or any other suitable method and the other end of each step member 18 is attached to the other one of the two ladder side rails 16 with welding or any other suitable method. Each ladder side rail 16 is preferably fabricated from an rectangular tube. Each step member 18 is preferably fabricated from an extruded rectangular tube. A plurality of lengthwise projections 22 are preferably formed on a top of each step member 18 to improve grip with footwear. The ladder hinge member 20 is attached to one end of the ladder side rail 16 with welding or any other suitable method.

With reference to FIGS. 5-6, it is preferable to pivotally attach a wheel 25 to a bottom end of each ladder side rail 16. The wheel 25 includes an axle 27 and a wheel portion 29. The wheel portion 29 is rotatably retained on the axle 27. A portion of the wheel portion 29 is preferably retained in an inner perimeter of the ladder side rail 16. Preferably, each end of the axle 27 is secured to opposing walls of the ladder side rail 16 with welding any other suitable attachment method. A welding flat 31 is preferably formed on each end of the axle 27, if welding is used for the attachment method.

Figure 3:
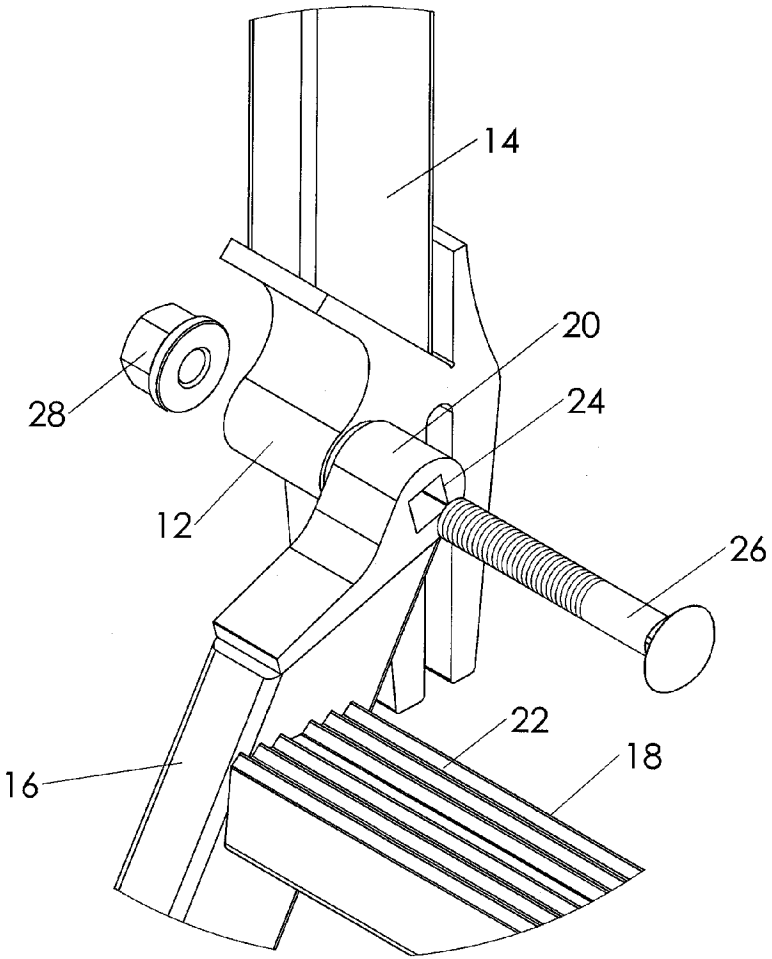
FIG. 3 is an enlarged perspective view of a first ladder hinge member before pivotal engagement with a first rub rail mounting member of a rub rail ladder in accordance with the present invention.
Figure 4:
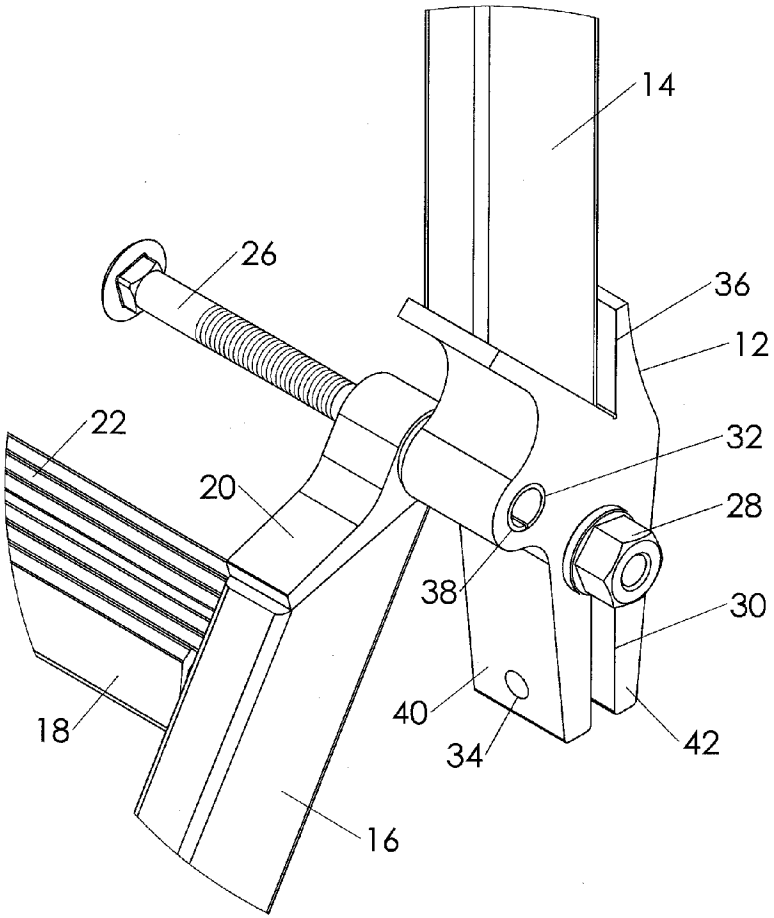
FIG. 4 is an enlarged perspective view of a second ladder hinge member before pivotal engagement with a second rub rail mounting member of a rub rail ladder in accordance with the present invention.

With reference to FIGS. 3-4, a square through opening 24 preferably is formed through ladder hinge member 20. It is preferable to use the square through opening 24, when a carriage bolt 26 is used for as a pivot pin. A hex nut 28 is threaded on to the carriage bolt 26 to pivotally retain the ladder portion 10 relative to one of the two rub rail mounting members 12. However, the ladder portion 10 may be pivotally retained relative to the two rub rail mounting members 12 with any suitable method or device.

Each rub rail mounting member 12 includes a rail slot 30, a pivot hole 32 and a lock through opening 34. The rail slot 30 is formed in one end of the rub rail mounting member 12 and a hand rail slot 36 may be formed in an opposing end of the rub rail mounting member 12. The hand rail slot 36 preferably has a substantial V-shape. The one end of the hand rail 14 is shaped to be received by the hand rail slot 36. The hand rail 14 is preferably attached to the rub rail mounting member 12 with welding. It is preferably to reinforce the pivot hole 32 with a steel bushing 38. The rail slot 30 creates a first lock finger 40 and a second lock finger 42. The lock through opening 34 is formed through the first and second lock fingers 40, 42 and substantially perpendicular to the rail slot 30.

In use, the rail slots 30 of the two rub rail mounting members 12 are engaged with a rub rail 102 of a truck trailer 100. It is preferable to insert a lock 104 or a fastener through the lock through opening 34 of at least one of the rub rail mounting members 12 to secure the rub rail ladder 1 to the truck trailer 100. Either a bottom end of each ladder side rail 16 rests on a support surface or the wheels 25 rest on a support surface, after attachment to the rub rail 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A trailer rub rail portable ladder, comprising:

two rub rail mounting members, each one of said two rub rail mounting members respectively includes a rub rail slot formed in respective ends of said two rub rail mounting members and are sized to receive a rub rail of a semi-trailer, said rub rail slots respectively create first and second lock fingers, wherein a lock through opening is formed through said first and second lock fingers of said mounting members, said lock through openings are sized to receive one of a bolt of a locking device and a fastener, said one of the locking device and the fastener preventing said trailer rub rail portable ladder from being removed from the rub rail; and one end of at least one hand rail is attached to at least one of said two rub rail mounting members; and a ladder portion includes two ladder side rails and a plurality of step members, said plurality of step members are retained between said two ladder side rails, said two ladder side rails respectively have one end which is pivotally retained relative to said rub rail mounting members, said ladder portion pivotable between a use position and a retracted position when said rub rail slots receive the rub rail, wherein a portion of said ladder portion is retained behind the rub rail when in said retracted position, all of said plurality of step members are located above the rub rail when in said retracted position, and all of said plurality of step members are located below and in front of a top surface of the rub rail when in said use position.

2. The trailer rub rail portable ladder of claim 1, further comprising:

a substantially V-shaped hand rail slot is formed in said at least one of said two rub rail mounting members to receive said one end of at least one hand rail.

3. The trailer rub rail portable ladder said one end of at least one hand rail is one end of a first hand rail and one end of a second hand rail, and a substantially V-shaped hand rail slot is formed in each one of said two rub rail mounting members to respectively receive said ends of said first and second hand rails.

4. The trailer rub rail portable ladder of claim 1 wherein:

an opposing end of said at least one hand rail is terminated with an end cap.

5. The trailer rub rail portable ladder of claim 1, further comprising:

a ladder hinge member is attached to one end of each said ladder side rail, said two rub rail mounting members are pivotally retained relative to said two ladder hinge members.

6. The trailer rub rail portable ladder of claim 5, further comprising:

a pivot pin is used to pivotally retain one of said two ladder hinge members relative to one of said two rub rail mounting members.

7. The trailer rub rail portable ladder of claim 1 wherein:

a plurality of lengthwise projections are formed on a top of each one of said plurality of step members.

8. The trailer rub rail portable ladder of claim 1 wherein:

said two ladder side rails, said plurality of step members and said at least one hand rail are each fabricated from a tubular material.

9. The trailer rub rail portable ladder of claim 1, further comprising:

each one of said ladder side rails are fabricated from a tube, wherein each one of said ladder side rails respectively has a wheel having an axle, each of said wheels is partially inserted into a perimeter of a tubular cross section of said ladder side rails respectively, and ends of each of said axles are attached to said tubes.

10. A trailer rub rail portable ladder, comprising:

two rub rail mounting members, each one of said two rub rail mounting members respectively includes a rub rail slot formed in one end of said two rub rail mounting members, a thickness of said rub rail slots is rigidly defined;

each one of said two rub rail mounting members respectively having one end of a hand rail attached thereto, each one of said two rub rail mounting members respectively having a substantially V-shaped hand rail slot to receive said ends of said hand rails; and a ladder portion includes two ladder side rails and a plurality of step members, said plurality of step members are retained between said two ladder side rails, said two ladder side rails respectively have one end which is pivotally retained relative to said rub rail mounting members, wherein said rub rail slots are sized to receive a rub rail of a semi-trailer, said ladder portion pivotable between a use position and a retracted position when said rub rail slots receive the rub rail, wherein a portion of said ladder portion is retained behind the rub rail when in said retracted position, all of said plurality of step members are located above the rub rail when in said retracted position, and all of said plurality of step members are located below and in front of a top surface of the rub rail when in said use position.

11. The trailer rub rail portable ladder of claim 10 wherein:

an opposing end of each of said hand rails respectively is terminated with an end cap.

12. The trailer rub rail portable ladder of claim 10, further comprising:

a ladder hinge member is attached to one end of each said ladder side rail, said two rub rail mounting members are pivotally retained relative to said two ladder hinge members.

13. The trailer rub rail portable ladder of claim 12, further comprising:

a pivot pin is used to pivotally retain one of said two ladder hinge members relative to one of said two rub rail mounting members.

* * * * *